United States Patent [19]

Murray, Sr.

[11] Patent Number: 5,056,480

[45] Date of Patent: Oct. 15, 1991

[54] LIQUID COMB COMBINATION AND METHOD FOR ITS MANUFACTURE

[76] Inventor: Ralph Murray, Sr., 19920 Conley, Detroit, Mich. 48234

[21] Appl. No.: 589,513

[22] Filed: Sep. 28, 1990

[51] Int. Cl.[5] ..... A45D 24/22

[52] U.S. Cl. ..... 132/114; 132/112; 132/113; 401/268; 401/274; 222/192; 222/210

[58] Field of Search ..... 132/112, 113, 114, 115, 132/116, 200; 401/268, 274; 83/908; 425/805; 222/144.5, 145, 192, 206, 210, 215

[56] References Cited

U.S. PATENT DOCUMENTS

| | | | |
|---|---|---|---|
| 1,172,889 | 2/1916 | Holden | 132/120 |
| 2,446,398 | 8/1948 | Wilson | 222/145 |
| 2,819,723 | 1/1958 | Meyer | 222/145 |
| 3,197,071 | 7/1965 | Kuster | 222/145 |
| 3,608,782 | 9/1971 | Sathicq | 222/145 |
| 4,592,376 | 6/1986 | Sigmund et al. | 132/112 |

FOREIGN PATENT DOCUMENTS

| | | | |
|---|---|---|---|
| 291682 | 6/1953 | Switzerland | 132/112 |

*Primary Examiner*—John J. Wilson
*Assistant Examiner*—Frank A. LaViola

[57] ABSTRACT

A water or liquid comb combination 10 with plural liquid distribution system consisting of an elongated reservoir 12 containing a plurality of compartments 14, 16 extending in the same direction as the elongated reservoir and each having an opening 22, 24 proximate a handle of the combination, a set of a plurality of hollow comb teeth 42, 44 extending from each of the plurality of compartments 34, 36, separately sized apertures 52, 54 for each set of the plurality of comb teeth for dispensing material/liquid conditioned on respective sizings of the separately sized apertures, material/liquid supply 34, 36 having a matching supply reservoir with an exit for each of the plurality of the compartment means of the elongated reservoir, and gate 26 disposed between the opening of the reservoir 12 and an operative ledge 28 of the exit of the supply 34, 36 for allowing for passage of a selected one of the supply 34, 36 to a selected compartment. The comb combination may be of plastic.

16 Claims, 1 Drawing Sheet

FIG. 1
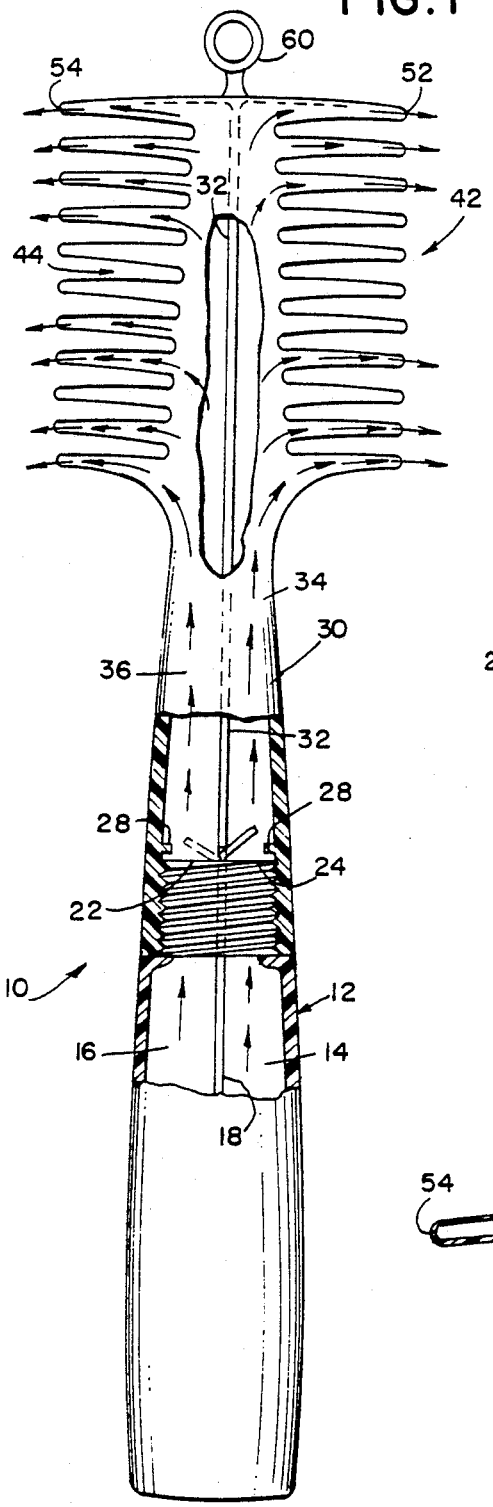
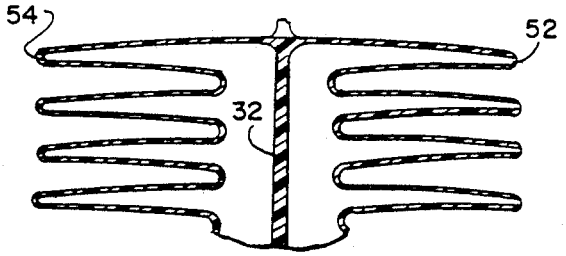
FIG. 3
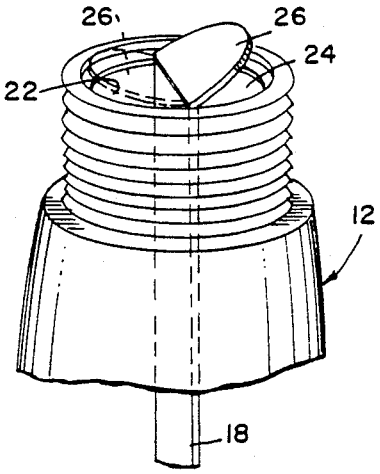
FIG. 2
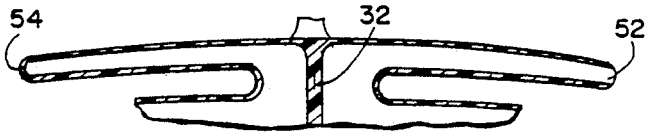
FIG. 4

LIQUID COMB COMBINATION AND METHOD FOR ITS MANUFACTURE

BACKGROUND OF THE INVENTION

1. Field of the Invention

The invention relates to an improved water or liquid comb combination 10 with plural liquid distribution system consisting of an elongated reservoir 12 containing a plurality of compartments 14, 16 extending in the same direction as the elongated reservoir and each having an opening 22, 24 proximate a handle of the combination, a set of a plurality of hollow comb teeth 42, 44 extending from each of the plurality of compartments 34, 36, separately sized apertures 52, 54 for each set of the plurality of comb teeth for dispensing material/liquid conditioned on respective sizings of the separately sized apertures, material/liquid supply 34, 36 having a matching supply reservoir with an exit for each of the plurality of the compartment means of the elongated reservoir, and gate 26 disposed between the opening of the reservoir 12 and an operative ledge 28 of the exit of the supply 34, 36 for allowing for passage of a selected one of the supply 34, 36 to a selected compartment. The comb combination may be of plastic.

The invention also relates more particularly to its method of making a combined plural dispenser consisting of the steps of forming hollow compartments about a mid-wall to comprise at least two compartments terminating in a closed portion at one end and terminating at the other in an opening for each of the compartments, forming sets of hollow teeth extending and communicating from opposite sides of the compartments having one set on one side with small end apertures and having another set on the other side with large end apertures, the small and large end apertures for dispensing selected kinds of liquids, forming a mating supply means to engage with the opening for each of the compartments, and constructing a plastic gate at opening of the supply means for it being manually so positioned to close off one opening of the compartments and to open another of the compartments.

The invention relates further to a device providing for a water or liquid comb combination made of plastic with a hollow interior, unique in construction and design, adaptable to an evergrowing market, may use water and many of the newer liquid products as well as the older products, for hair preparations, shampoo conditioners, jells, dyes, moisturizers, hair lotions and perms, because if all of these types of liquid dyes/jells would go into one container of comb is problem, some believe jell would clog at exit and dye would run out; water comb combinations solves the problem; water comb has at least two chambers separated by a divider wall or member, one chamber for watery liquids such as dyes, perms, rinses, moisturizers, and all thin liquids; the other chamber is for thicker liquids, shampoos, conditioners, and jells of more viscous nature; use of the invention prevents the device of the invention from running or dripping the dispensible materials; and the method of constructing and filling the supply tubing thereof as is more particularly described herein.

2. Description of the Prior Art

Various prior art dispensing combs and combs with distribution devices, and the like, as well as apparatus and method of their construction in general, are found to be known, and exemplary of the U.S. prior art are the following:

Edwards—U.S. Pat. No. 1,051,714
Ellzey—U.S. Pat. No. 1,827,425
leserek—U.S. Pat. No. 3,520,311
Bloem—U.S. Pat. No. 4,057,901
Kaiser—U.S. Pat. No. 4,237,822
Mueller—U.S. Pat. No. 4,566,472
Nolin—U.S. Pat. No. 4,605,026
Buseh—U.S. Pat. No. 4,867,183

Edwards shows a comb having a hollow back communicating with hollow teeth with openings or apertures for dispensing a fluid. leserek shows a comb with fluid distribution means and means for attaching a hair care device.

Bloem shows a wet comb for metering a liquid preparation to the hair for flow by means of the force due to gravity out of the chamber and in the direction of the teeth of the comb. Nolin shows a comb for dispensing treatment solution to hair.

These patents or known prior uses teach and disclose various types of combs and combs for dispensing solutions of sorts and of various manufactures and the like as well as methods of their construction, but none of them whether taken singly or in combination disclose the specific details of the water comb combination of the invention in such a way as to bear upon the claims of the present invention.

SUMMARY OF THE INVENTION

An object, advantage and feature of the invention is to provide a novel comb combination that can selectively dispense thick and thin materials or liquids such as dyes, and other liquid without having it run on the face and head of the users; the water or liquid comb combination seeks to eliminate these problems, and it has sets of teeth, one set with small openings for dispensing thin liquids, and another set with larger openings for dispensing thicker liquids through the larger openings.

Another object of the invention is directed further to a device providing for the outward flow of supply liquid in a liquid comb combination and the method of filling the supply means thereof.

Also an object of the invention is to provide a simple and direct method for an improved construction of making a combined plural liquid dispenser consisting of the steps of forming hollow compartments about a mid-wall to comprise at least two compartments terminating in a closed portion at one end and terminating at the other in an opening for each of the compartments, forming sets of hollow teeth extending and communicating from opposite sides of the compartments having one set on one side with small end apertures and having another set on the other side with large end apertures, the small and large end apertures for dispensing selected kinds of liquid, forming a mating supply means to engage with the opening for each of the compartments, and constructing a plastic gate at opening of the supply means for it being manually so positioned to close off one opening of the compartments and to open another of the compartments.

Another object of the invention is to provide a novel and improved method of construction in making reservoirs having a gate member in which the reservoir carries a supply liquid.

These together with other objects and advantages which will become subsequently apparent reside in the details of the process and operation thereof as more fully hereinafter is described and claimed, reference being had to the accompanying drawings forming a part thereof, wherein line numerals refer to like parts throughout.

DESCRIPTION OF THE SEVERAL VIEWS OF THE DRAWINGS

FIG. 1 is a side elevational view of a water or liquid comb shown partially in section and illustrating a typical construction of the water comb combination according to a preferred embodiment and best mode of the present invention.

FIG. 2 is a partial perspective view showing the reservoir of the combination comb and embodying the concepts of the invention.

FIG. 3 is a sectional view taken from a portion of FIG. 1.

FIG. 4 is an enlarged view of an end of the comb combination showing sizings of the apertures of the comb and details of a wall of the comb made integral with a hook member.

DESCRIPTION OF A PREFERRED EMBODIMENT OF THE INVENTION

Referring now to the drawings there is shown in FIG. 1 a water or liquid comb combination 10 with selective, plural distribution container system consisting of an elongated reservoir 12 containing a plurality of compartments 14, 16 extending in the same direction as the elongated reservoir 12 and separated by a wall 18; each of the compartments 14, 16 having openings 22, 24 proximate an end of the reservoir 12 of the combination 10. The reservoir 12 serves as a means for manually holding the combination. Extending from the distal end of the wall 18 is a plastic semicircular flap 26 which is suited for manually positioned in either of two locations for selectively closing off one of the compartments 14, 16, as shown. When a selected location is determined, the flap 26 is locked in place by use of a operative ledge 28 of a comb 30 which serves to maintain the flap 26 in place during use, so that material/liquid in the other of the compartments 14, 16 is dispensible through its opening 22, 24 to the comb 30.

The comb 30 contains an extension wall 32 of wall 18 for sequestrating the material/liquid flow from the source compartments 14, 16 to the corresponding compartments 34, 36, which flow may continue into the comb 30 on within the respective compartments 34, 36 and thence to one of the set of a plurality of hollow teeth 42, 44 of the comb 30.

The set of a plurality of hollow comb teeth 44, 46 extending from each of the plurality of compartments 34, 36, and as shown in FIG. 4, there are separately sized apertures 52, 54 for each set of the plurality of comb teeth 42, 44 for dispensing material/liquid conditioned on respective sizings of the separately sized apertures 52, 54. The material/liquid supply compartments 34, 36 are connected to matching containers 14, 16, and apertures 52, 54 provide exiting for each of the plurality of the compartments 34, 36 of the elongated reservoir 12.

The flap 26 serves as a gate disposed between the openings 24, 26 of the reservoir 12 and the material/liquid exits the reservoir 12 for allowing for passage of a selected one of the materials/liquid to selected compartments.

The comb combination 10 is constructed of plastic material or other suitable materials as may be desired. The plastic of the supply member may be flexible and the comb compartments may be of rigid or durable plastic. The plastic may be colored as desired and suitable for the user.

A hook member 60 is provided to store or hang the comb combination 10 when not in use.

The comb combination 10 is responsive to manual pressure applied by the user in forcing the reservoir 12 to drive material/liquid for distribution through the selected openings 52, 54.

The apparatus of the comb combination 10 of the invention may be so constructed and arranged in its component parts that it may be assembled as a kit or in kit form.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed and desired to be secured by Letters Patent is:

1. Liquid comb combination with plural distribution system comprising an elongated reservoir containing a plurality of compartment means extending in the same direction as the elongated reservoir and each having an exiting means proximate a handle of the combination, liquid supply means having a matching supply reservoir with an opening means for each of the exiting means of the plurality of the compartment means of the elongated reservoir, a set of a plurality of hollow comb teeth means extending from each of the supply means, separately sized apertures for each set of the plurality of comb teeth means for dispensing liquid conditioned on respective sizings of the separately sized apertures, and liquid supply means having a matching supply reservoir with an exiting means for each of the plurality of the compartment means of the elongated reservoir, and gate means disposed between the opening of the supply means and the exiting means of the compartment means for allowing for passage of a selected one of the compartment means to a selected one of the supply means.

2. The apparatus of claim 1 wherein the comb combination is constructed of plastic.

3. The apparatus of claim 1 wherein an extension surface of the supply means is responsive to an application of pressure in forcing the supply means to drive liquid for distribution.

4. The apparatus of claim 1 wherein an extension of a mid-wall of the elongated reservoir includes a hook at a distal end from the opening.

5. The apparatus of claim 1 wherein the apertures of the hollow teeth on each side are of a common diameter.

6. The apparatus of claim 1 wherein diameters of the apertures on one side are small and those on the other side are large.

7. The apparatus of claim 1 wherein the combination is made of flexible plastic.

8. The apparatus of claim 1 wherein the comb compartment means is made of rigid plastic and the supply means is of flexible plastic.

9. The apparatus of claim 1 wherein the system is of colored plastic.

10. The apparatus of claim 1 wherein the system is of a durable plastic.

11. Method of making a combined plural liquid dispenser comprising the steps of forming hollow compartments about a mid-wall to comprise at least two compartments terminating in a closed portion at one end and terminating at the other in an exit means for each of the compartments, forming a mating supply means having opening means to engage with the exit means for each of the compartments, forming sets of hollow teeth extending and communicating from opposite sides of the supply means having one set on one side with small end apertures and having another set on the other side with large end apertures, the small and large end apertures for dispensing selected kinds of liquids, and constructing a plastic gate at the opening means of the supply means for it being manually so positioned to close off one exit means of the compartments and to open another of the compartments.

12. The method of claim 11 wherein the mid-wall terminates in a hook.

13. The method of claim 11 wherein the dispenser is made of durable plastic.

14. The method of claim 11 wherein the comb combination is responsive to pressure in forcing the supply means to drive liquid for distribution.

15. The method of claim 11 wherein the dispenser is constructed of colored plastic material.

16. Liquid comb combination with a distribution system comprising an elongated reservoir containing a compartment means having opposite sides extending in the same direction as the elongated reservoir and the reservoir having an exiting means proximate a handle of the combination, the elongated reservoir being adapted for engagement with liquid supply means having a matching supply reservoir with an opening means for engagement with the exiting means of the compartment means, a set of comb teeth means extending from a side of each of the opposite sides of the supply means, separately sized apertures for at least one of the set of the comb teeth means provided for dispensing liquid conditioned on respective sizing of the separately sized apertures thereof, and flap means for closing off the opening means proximate the handle of the combination.

* * * * *